United States Patent [19]

Poteet

[11] 4,339,069

[45] Jul. 13, 1982

[54] UNITARY KNOCKDOWN FILE BOX

[75] Inventor: Wendell A. Poteet, Fort Worth, Tex.

[73] Assignee: O'Grady Containers, Inc., Fort Worth, Tex.

[21] Appl. No.: 179,508

[22] Filed: Aug. 19, 1980

[51] Int. Cl.[3] ..... B65D 5/22
[52] U.S. Cl. ..... 229/36
[58] Field of Search ..... 229/36, 35

[56] References Cited

U.S. PATENT DOCUMENTS

| | | | |
|---|---|---|---|
| 1,174,605 | 3/1916 | Palmer | 229/36 |
| 1,525,360 | 2/1925 | Blandford | 229/36 |
| 2,536,948 | 1/1951 | Lehman | 229/36 |
| 3,395,850 | 8/1968 | Kotowick | 229/36 |
| 3,520,409 | 7/1970 | Gibbs | 229/36 |
| 3,889,868 | 6/1975 | Brucknet et al. | 229/36 |

FOREIGN PATENT DOCUMENTS

| | | | |
|---|---|---|---|
| 943904 | 3/1949 | France | 229/36 |

*Primary Examiner*—Herbert F. Ross
*Attorney, Agent, or Firm*—Wofford, Fails & Zobal

[57] ABSTRACT

A box for use as a file container or the like characterized by a single piece, corrugated cardboard blank that is foldable into a completed configuration with lockable top panels that are openable and closable to allow access to the interior. The end portions of the sides have locking tabs so as to be locked into position and facilitate folding the rest of the box into place. The ends have two outer portions that fold over the end portions of the sides to make a triple strength end with vertical corrugations for stack strength. Hand holes are provided to facilitate lifting the box. The locking tab on one of the top panels is provided at each end of a foldable flap that folds over the other top panel. The locking tabs lock into locking aperture at each end by simply folding down.

3 Claims, 6 Drawing Figures

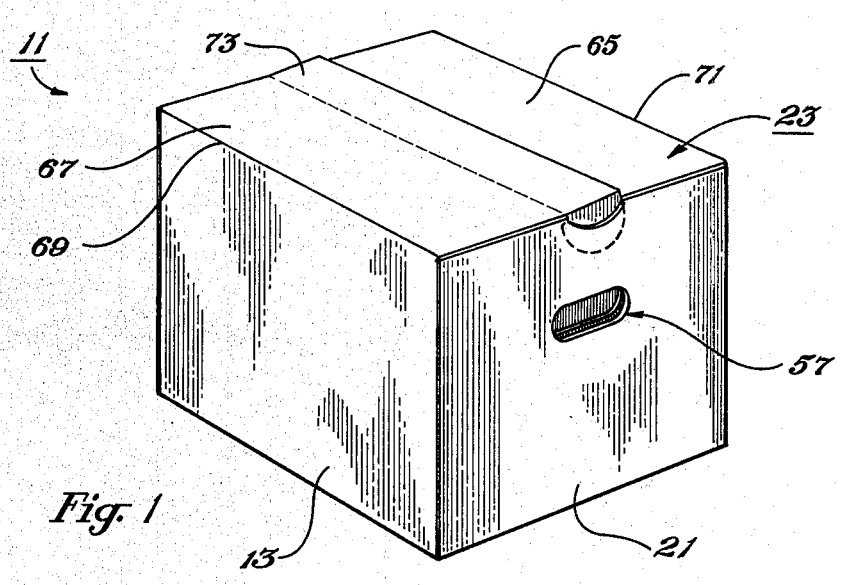
Fig. 1
Fig. 2
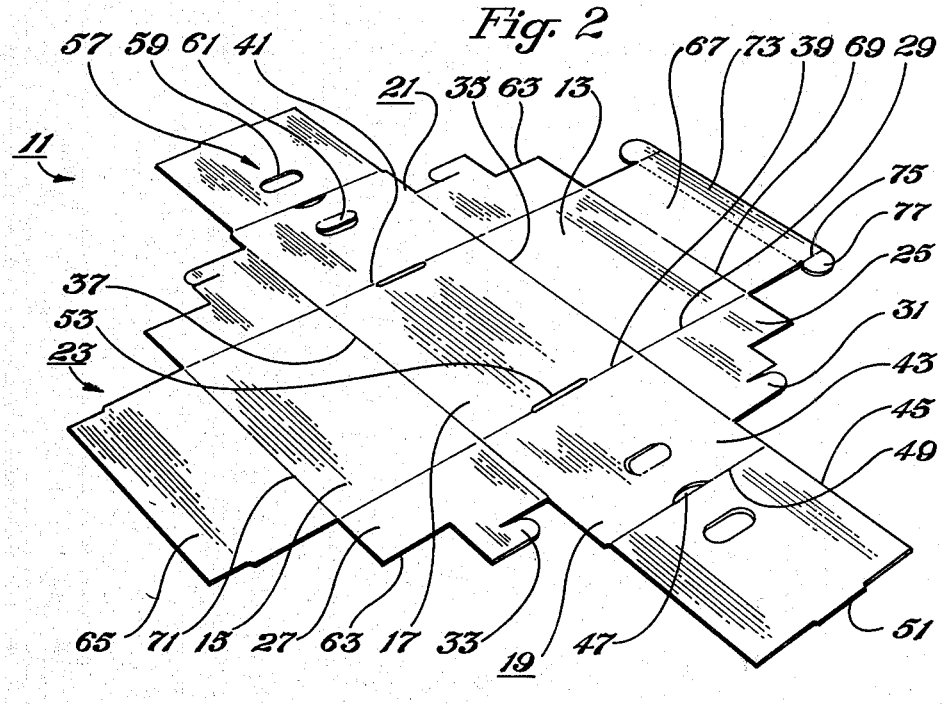

UNITARY KNOCKDOWN FILE BOX

FIELD OF THE INVENTION

This invention relates generally to foldable storage boxes that are folded from a one-piece blank of material. More particularly, it relates to an improvement in a one-piece self-locking, corrugated cardboard shipping container that has high stack strength and is precut and scored in preparation for folding into a finished box configuration.

Foldable storage boxes are designed to be stored and shipped in the flat configuration so that a larger number can be shipped at the same cost; then folded into the finished box configuration when needed. Preferably, the box is folded from a one-piece blank of material with all parts of the boxes connected together and without requiring separate tops or the like. It is desirable that such boxes be strong and durable so they will not be easily crushed. It is particularly important that they be easy to assemble and have relatively high stack strength and allow easy access to the contents of the container if it is used as a file box or the like.

A wide variety of different types of boxes are known in the prior art. Typical of these are the following U.S. Pat. Nos. 2,281,486 shows a file box with a closure fastener string and a closure button at each end. Similarly, 2,339,691 shows overlapping top flaps with one of the flaps having an aperture for insertion of a closing string therethrough. 2,367,117 had a very similar structure except that the closing string tied to side strings rather than end strings. 2,598,123 describes a file container in which the top has downwardly depending flanges adjacent each other for strength in sustaining planar loads on the top. 2,807,406 describes a box having a reinforcing lid over the center of the top and along the midpoint of the bottom, coupled with tie strings at each end of the top. 3,055,569 describes a one-piece carton for transporting or storing beverages and having multiple end walls and a multiple base for ruggedness and strength. 3,119,545 describes a shipping container having a multiple piece top and foldup end tabs that fold through apertures for strength. 3,301,461 describes file cases in which a single foldable top has downwardly depending flanges along three edges. 3,667,666 describes a foldable storage box with an open top and separate top closure.

Thus it can be seen that the prior art does not provide the desirable feature of having preliminary locking tabs to facilitate setting up a box, allowing openable and closable features without requiring separable ties or that has a plurality of end segments having vertically running corrugations for stack strength.

SUMMARY OF THE INVENTION

Accordingly it is the object of this invention to provide a one-piece storage box that has preliminary locking tabs that facilitates assembly into a final configuration, that allows openable and closable top without requiring separate string tiedowns and that provides triple supporting walls in the ends with vertical running corrugations for high strack strength, thereby alleviating the difficulties of the prior art.

It is a particular object of this invention to provide all of the foregoing in conjunction with an overlapping top structure with lock tabs and lifting means.

These and other objects will become apparent from the descriptive matter hereinafter, particularly when taken in conjunction with the appended drawings.

BRIEF DESCRIPTION OF THE DRAWINGS

FIG. 1 is an isometric view of an assembled box configuration.

FIG. 2 is a planar view of a single piece blank foldable into the configuration of FIG. 1.

DESCRIPTION OF THE PREFERRED EMBODIMENTS

Referring to the FIGS. and particularly the FIGS. 1 and 2, box 11 is a single piece, corrugated cardboard blank that is foldable into a completed box configuration. The blank is cut from a flat sheet of material such as paperboard or cardboard from which the box is to be made. The blank is cut and scored in such a way that it can be folded to form the box. The term "cutting" is employed to mean severing completely through the material whereas "scoring" or "creasing" means crimping the material where the folds in the material are supposed to occur when folding into the box configuration. The scoring or creasing does not cut through the material it simply facilitates the folding along the desired lines The box, or blank, 11 has two sides, or side walls, 13 or 15, a bottom 17, ends 19, 21 and top 23.

Figure 5:
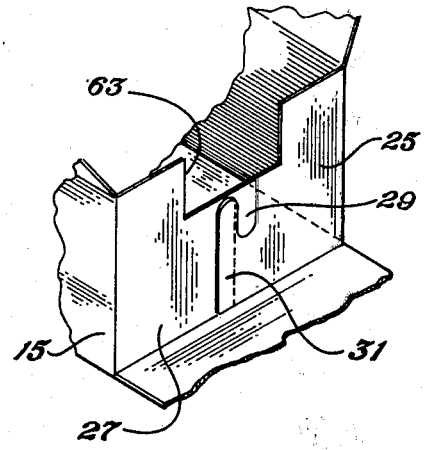
FIG. 5 is a partial isometric view showing the preliminary locking tabs at their respective ends.
Figure 6:
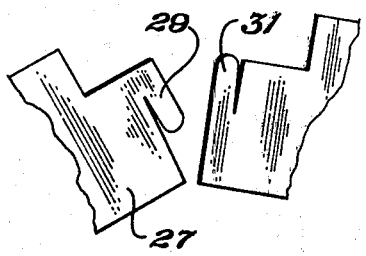
FIG. 6 is a partial view of the locking tabs prior to locking into place.

Each of the side walls 13 and 15 has hingedly connected at respective ends respective fold-over end portions 25, 27. The line of connection comprises a respective foldable crease 29. The end portions 25, 29 have respective interlocking tabs 31, 33 for allowing the end portions to be folded into position and locked with the folding tabs to facilitate the additional folding into a finished box. The end portions have vertical corrugations in the finished box position, the corrugations traversing longitudinally of the sides in the blank 11. As can be seen in FIGS. 5 and 6, when the end portions of the respective sides fold over, the tabs 29, 31, interlock to hold the end portions in this position and free the hands of the person doing the folding for folding the remainder of the blank into the box configuration. End portions are folded 90° to the sides when the sides are folded 90° to the bottom.

The bottom 17 is a substantially planar piece of cardboard in the center of the blank. The bottom is hingedly connected with the two side walls at their bottoms via respective foldable creases 35, 37. Herein the terms "vertical" and "bottom of the sides" are used to speak of the finished box configuration where the bottom is substantially horizontal, as by setting on the floor or the like. The bottom is similarly connected by respective foldable creases 39, 41 with the two ends 19, 21.

The respective box ends 19, 21 comprise respective inner and outer portions 43, 45. As indicated, the respective inner portions 43 are hingedly connected via their respective foldable creases 39, 41 with the bottom 17.

Each of the box ends 19, 21 have adjacent its midpoint a lock aperture 47 and 180° fold crease 49. The 180° fold crease is actually a pair of closely adjacent creases that enable the outer and inner portions to be moved upwardly around and folded over the end portions 25, 27 to encompass the end portions with the lock tabs 31, 33 engaged. The outer portion has a short tab 51 that fits into aperture 53 intermediate the bottom and the inner portion of the ends when folded into position. This tab inserted in the aperture 53 holds the configuration of the triple ends, as can be seen in FIG. 3.

The box ends have longitudinally diposed corrugations that traverse longitudinally through the bottom and the ends such that in finished box configuration the corrugations are vertical for stacking strength.

Figure 3:
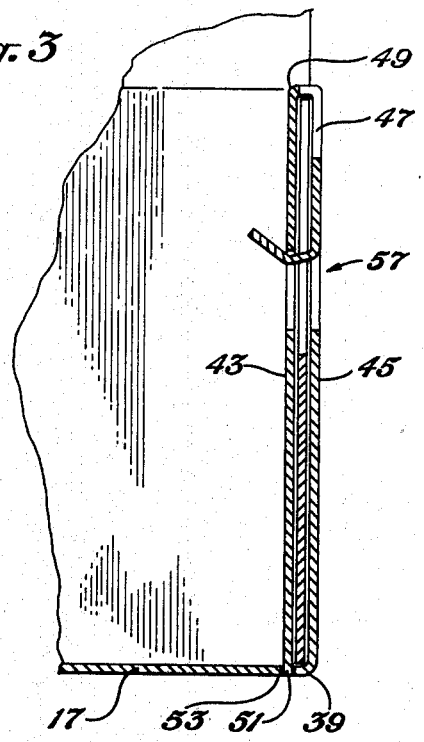
FIG. 3 is a partial cross sectional view showing the triple strength ends, lock aperture and lifting means.

The ends have respective lifting means 57, FIGS. 1, 2 and 3, for lifting the box.

The lifting means comprises mating apertures 59, 61 in the respective inner and outer portions 43, 45 and a cut out recess 63, FIGS. 2 and 3, in the end portions 25, 27 of the sides 13, 15. The cut out recess 63 also provides space for receiving a lock tab of a foldable flap of a top panel as will be described in more detail hereinafter.

Figure 4:
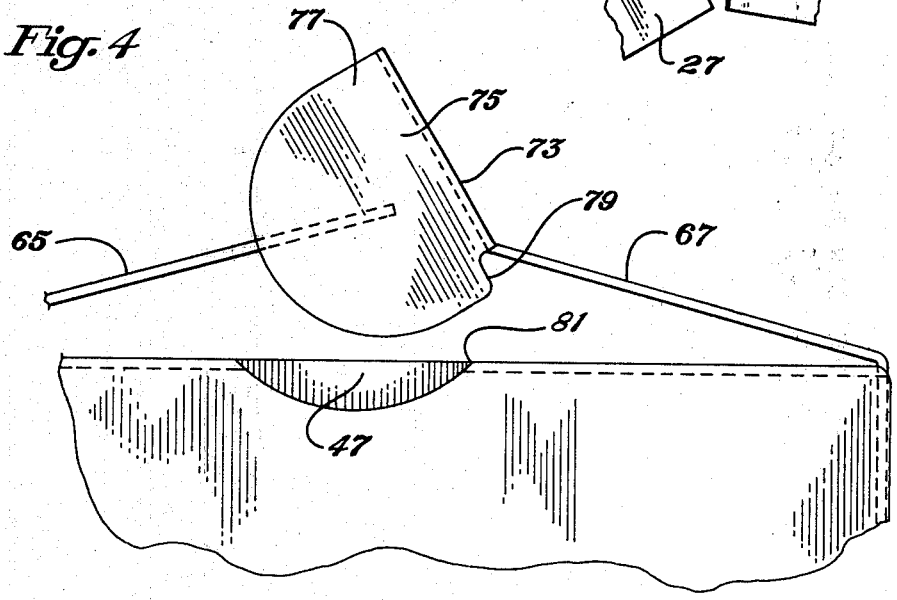
FIG. 4 is a partial side elevational view showing the lock tabs and lock apertures of the embodiment of FIG. 1.

The two respective, oppositely disposed top panels 65, 67 of the top 23 are hingedly connected via respective foldable creases 69, 71 with the top of the respective sides. At least one of the top panels, such as the top panel 67, has a foldable flap 73, FIGS. 1, 2 and 4. The foldable flap is adapted to fold over the free end of the oppositely disposed top panel 65. The foldable flap has hingedly connected at each end via foldable crease 75, lock tab 77. The lock tab 77 is adapted to be lockingly inserted within the lock aperture 47 of the ends for holding the top closed. Specifically, the lock tab 77 has a protruding shoulder 79 that catches underneath the edge 81 of the aperture 47 when the tab 77 is folded downwardly into position in the finished box configuration. Yet, the flap can be readily rotated 90° upwardly to free the respective top panels and facilitate access to the interior of the box. As indicated hereinbefore, the cut away portion, recess, 63 also provides a space intermediate the inner and outer portions 43, 45 to receive the flap 77 in the lock position for holding the top closed.

In operation, the blank 11 is cut and creased, or scored, as described hereinbefore and illustrated in FIG. 2. Thereafter, at such time as a box 11 is to be assembled, the respective sides 15 and 13 are folded 90° to the bottom and the respective end portions 25, 27 are folded 90° across the ends and intermediate the side walls 13 and 15. The locking tabs 31, 33 are engaged to hold the end portions in this folded position. Thereafter, the respective box ends 19, 21 are folded upwardly with the inner portion on the exterior of the end of portions of the sides and the outer portion 45 folded over and folded interiorly of the end portions 25, 27 of the sides. The tab 51 is inserted in the aperture 53 to complete the end assembly.

After the sides and ends are assembled, the material can be put into the box and the top closed as shown in FIG. 1. The top is closed by folding the panel 65 over and then folding the panel 67 over this with the flap 73 being folded over the free end of the panel 65. When the lock tabs 77 are inserted into the lock aperture 47, the shoulder 79 engages the top part of the edge 81 of the aperture defining wall to hold the box in a closed configuration.

From the foregoing it can be seen that this invention achieves the objects delineated hereinbefore and provides a box having the features that obviate the disadvantages of the prior art. Particularly, the box has triple end stack strength, has a locking means without having special tie strings or the like, and that can be readily assembled through the lock tabs of the end portions of the sides. Moreover, the flap and lock tabs facilitate entry and reclosure; particularly after the user acquires the feel for and becomes adept at the simplified approach used in this invention.

Although the invention has been described with a certain degree of particularity, it is understood that the present disclosure is made only by way of example and that numerous changes in the details of construction and the combination and arrangement of parts may be resorted to without departing from the spirit and the scope of the invention, reference for the latter purpose being had to the appended claims.

I claim:

1. A storage box used for a file container or the like comprising:

a single piece, corrugated cardboard blank that is foldable into a completed configuration that has openable and closable top without requiring strings, latches, latch buttons and the like;

said blank including two outer side walls, each side wall having hingedly connected at respective ends via foldable creases respective fold-over end portions that have respective interlocking tabs for allowing said end portions to be folded into position and locked with said tabs to facilitate additional folding into a finished box, said end portions having corrugations traversing longitudinally upwardly from said bottom in the finished box position;

bottom hingedly connected with said two sides at their bottoms with a foldable crease;

two respective box ends having respective inner and outer portions and hingedly connected at a respective inner end of said inner portions to said bottom by a foldable crease;

each said box end having adjacent its midpoint a lock aperture and a 180° foldable crease such that its inner and outer portions can fold over and encompass said respective end portions of said sides and leave said lock aperture exposed to received a lock tab for holding a top closed;

said ends thereby comprising triple strength panels with vertical corrugations for high strength for stacking;

said ends having longitudinally disposed corrugations such that said corrugations are vertical in the finished box and parallel with the corrugations in said end portions of said sides in said finished box for stacking strength;

said ends having respective lifting means for lifting said box, each lifting means in said ends comprising mating apertures in each respective pair of said inner and outer portions of said ends and a cut out recess in said end portions of said sides, said cut out recess also providing space for receiving a lock tab of a foldable flap of a top panel;

two respective oppositely disposed top panels hingedly connected respectively at one end with the respective tops of respective said side walls by a foldable crease;

one of said top panels having a foldable flap adapted to fold over the free end of the oppositely disposed top panel, said foldable flap having hingedly connected at each end by a foldable crease a lock tab adapted to be lockingly inserted within said lock aperture and said cut out recess of said ends for holding said top closed and being lifted from said lock aperture for easy opening of said top panel to allow access to the interior of said storage box as infrequently desired.

2. The storage box of claim 1 wherein said lock tabs have respective shoulders that protrude interiorly of said lock aperture and beneath the edge thereof to prevent undesired release of said foldable flap of said top and which automatically releases when said flap is unfolded 90° to open said storage box.

3. The storage box of claim 1 wherein only one of said top panels has said foldable flap and said lock tabs at each end and the other of said top panels has at its free end a planar end that extends under said foldable flap.

* * * * *